United States Patent [19]

Yamauchi et al.

[11] Patent Number: 4,880,175

[45] Date of Patent: Nov. 14, 1989

[54] TENSION SETTING AND CONTROLLING METHOD AND APPARATUS IN AN AUTOMATIC WINDER

[75] Inventors: Tosio Yamauchi, Kyoto; Shoichi Tone, Kyoto; Yutaka Ueda, Nara, all of Japan

[73] Assignee: Murata Kikai Kabushiki Kaisha, Kyoto, Japan

[21] Appl. No.: 180,370

[22] Filed: Apr. 11, 1988

[30] Foreign Application Priority Data

| | | | |
|---|---|---|---|
| Apr. 14, 1987 | [JP] | Japan | 62-091124 |
| Jun. 10, 1987 | [JP] | Japan | 62-144339 |
| Jun. 13, 1987 | [JP] | Japan | 62-147397 |
| Jul. 10, 1987 | [JP] | Japan | 62-173467 |

[51] Int. Cl.[4] ..... B65H 54/20; B65H 59/00; B65H 59/10; B65H 59/38

[52] U.S. Cl. ..... 242/35.5 R; 242/36; 242/45; 242/150 M; 242/154

[58] Field of Search ..... 242/35.5 R, 35.5 A, 242/35.6 R, 36, 147, 149, 150 R, 150 M, 153, 154, 155 R, 155 M, 45, 18 R

[56] References Cited

U.S. PATENT DOCUMENTS

| | | | |
|---|---|---|---|
| 2,618,445 | 11/1952 | Buder | 242/154 |
| 2,705,362 | 4/1955 | Roughsedge | 242/155 M X |
| 2,754,071 | 7/1956 | Furst et al. | 242/154 |
| 2,845,235 | 7/1958 | Wilcox | 242/155 M |
| 3,300,161 | 1/1967 | Hermanns | 242/154 |
| 3,476,329 | 11/1969 | Felix | 242/36 |
| 3,739,996 | 6/1973 | Matsui et al. | 242/36 X |
| 3,774,860 | 11/1973 | Loepfe | 242/36 |
| 4,313,578 | 2/1982 | Wilson et al. | 242/149 |

*Primary Examiner*—Stanley N. Gilreath

*Attorney, Agent, or Firm*—Spensley, Horn, Jubas & Jubas

[57] ABSTRACT

In an automatic winder, the tension device provided on each winding unit has a tenser in contact with a yarn to apply a resistance thereto, and a driving actuator of said tenser member, and each of the actuators provided on each winding unit is associated with a control device positioned separately from each winding unit, and adjustment of the tenser member is remote-controlled. The control device is used to vary the yarn tension in accordance with amount of yarn layer on a package, winding speed of a yarn and the like.

20 Claims, 12 Drawing Sheets

TENSION SETTING AND CONTROLLING METHOD AND APPARATUS IN AN AUTOMATIC WINDER

FIELD OF THE INVENTION

The present invention relates to a tension setting and controlling method and apparatus in an automatic winder having a plurality of winding units juxtaposed.

RELATED ART STATEMENT

A spinning bobbin produced by a spinning frame, particularly by a ring spinning frame, is supplied to an automatic winder in the succeeding step and wound back in a fixed amount of yarns, and a package of a fixed shape while removing defects of yarns.

That is, the yarn on the spinning bobbin supplied to the fixed position of each winding unit of the automatic winder is drawn out upwardly in a direction of an axis of the bobbin, and a yarn separated from a layer of yarns travels while effecting ballooning, and the yarn is wound about a package while being traversed by a traverse device via a tension device, a slub catcher and the like.

Such an automatic winder as described above is constituted by one winder with a plurality of winding units juxtaposed. In case of 60-units, the length of a machine bed is 20 meters.

In the above-described winding unit, there is provided a tension device for applying a tension of a yarn released from the bobbin. Various types of such devices have been proposed and operated which include a type in which a bend is applied to a yarn by a zigzag guide, a type in which a yarn is nipped between two press plates to apply tension thereto, and the like.

However, every time when the kind, thickness, travel speed and the like of yarns to be processed, the tension device has to be fine-adjusted so as to meet the conditions of the yarns to be processed. Since in prior art, the change in setting tension is made in such a manner that an operator operates an adjusting screw for each winding unit, when a yarn is set at the time of lot change, it has required a long time to change the setting of a number of winding units as described above.

In such a winder, if winding is carried out with constant tension at all the time in forming a package, an inner layer of the package is compressed by a compressive force of an outer layer depending on the kind of yarns, sometimes producing a buldge in the inner layer side of the end of the package.

Furthermore, in such a winder as described, a yarn drawn out of a spinning bobbin on the feed side is drawn out upward in a direction of an axis of the bobbin. Therefore, a yarn separated from a yarn layer travels while ballooning.

In the case where the yarn layers on the spinning bobbin are sufficient, there involves no problem. However, when winding proceeds and the yarn layers reduce, the reduced yarn layers Y1 are positioned at the lower end of a winding tube B as shown in FIG. 12 in terms of the winding process in the spinning frame, and a yarn Y released in such a state travels upward while being wound around the surface of the tube B. An angle of separation from the yarn layer is reduced, and a tension caused by excessively great resistance is produced in the travelling yarn due to friction between yarns, contact with the winding tube, and the like, as a consequence of which the yarn is cut. Such a cut of yarn is liable to occur as the speed of the travelling yarn increases.

Accordingly, winding is stopped for a yarn joining operation following every cut of the yarn. An amount of yarn per spinning bobbin is for example, a hundred and fifty grams or so. Many spinning bobbins are supplied to produce a single fully wound package. The yarn cutting per bobbin produced as described above results in the lowering of working efficiency of the winder.

OBJECT AND SUMMARY OF THE INVENTION

It is an object of the present invention to propose a method and apparatus for setting and controlling of each winding unit collectively by remote control.

In an embodiment of the present invention, the tension device provided on each winding unit has a tenser in contact with a yarn to apply a resistance thereto, and a driving actuator of said tenser member, and each of the actuators provided on each winding unit is associated with a control device positioned separately from each winding unit, and adjustment of the tenser member is remote-controlled.

In case that a variable tenser is provided on a winding unit, the variable tenser is controlled as layers of yarn of a package increase the yarn with the association between the yarn layers and winding tension.

An embodiment of the present invention also provides an arrangement provided with a tension sensor for detecting tension of a travel yarn every winding unit, a tension device for controlling tension of a yarn on the basis of a variation signal of yarn tension provided by said sensor, and winding speed control means for controlling winding speed of a yarn on the basis of the signal of said tension sensor, wherein when exceeding a controllable tension range that may be controlled merely by said tension device, the winding speed is controlled by the action of said winding speed control means.

DETAILED DESCRIPTION OF PREFERRED EMBODIMENTS

An embodiment of the present invention will be described with reference to the drawings.

Figure 4:
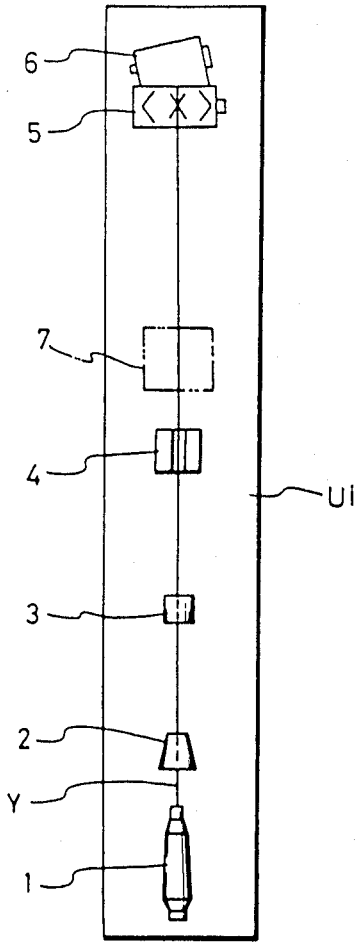
FIG. 4 shows a schematic construction showing one example of a winding unit.

In FIG. 4, a winding unit (Ui) constituting a winder is schematically shown. A yarn Y drawn out of a feed bobbin 1 passes a balloon breaker 2, a tension device 3 and a slub catcher 4, and is wound on a package 6 into a fixed shape while being transversed by a transverse drum 5. Reference numeral 7 designates a yarn joining device such as a splicer or a knotter.

Figure 5:
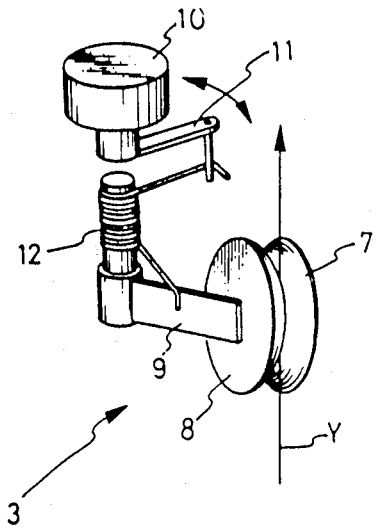
FIG. 5 is a perspective view showing an embodiment of a tension device.

The aforesaid tension device 3 can be of various types, but FIG. 5 shows one embodiment. According to this type, the yarn Y is inserted between two tension disks 7 and 8, and a press force caused by the tension disks 7 is exerted on the yarn to apply a force which comprises a resistance against yarn travel to the yarn. That is, in the tenser 3 of the type in which the yarn Y is sandwiched and pressed between two disks 7 and 8 one of which is fixed and the other is pressed against the former, a movable disk 8 is oscillatably supported by a support arm 9, a spring 12 is provided opposite ends of which are respectively engaged at an oscillating rod 11 oscillated by an actuator 10 such as a rotary solenoid and the support arm 9 of said disk 8, and the oscillating rod 11 is oscillated by operation of the actuator to increase and decrease the bias force of the spring 12 whereby the urging force between two disks 7 and 8 is varied to control the tension of the travelling yarn Y.

The winding tension of yarn by the tension device 3 is generally from 8 to 12% of single yarn strength. Accordingly, the tension value varies with count and kind of yarns, and an amount of tension applied by the tension device is adjusted by the yarn.

Figure 1:
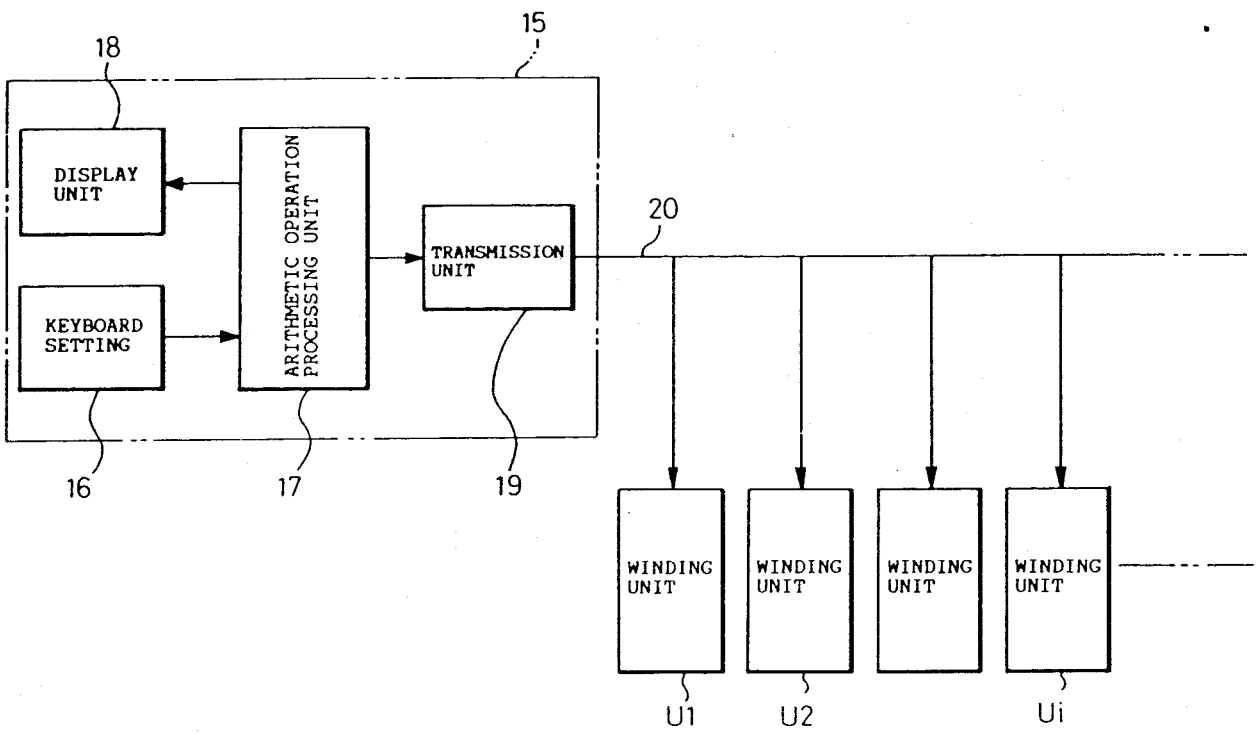
FIG. 1 is an overall block diagram of the apparatus according to an embodiment of the present invention.
Figure 2:
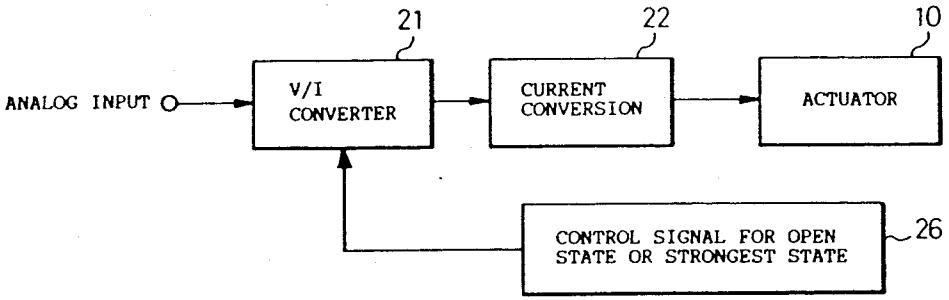
FIG. 2 is a block diagram for setting tension within the winding unit.

FIGS. 1 and 2 show an overall block diagram of a tension setting device and a block diagram in a winding unit.

More specifically, tension setting by remote control is inputted into a central processing unit 17 such as a microcomputer or a hard logic by a keyboard 16 of a control device 15 in FIG. 2. Reference numeral 18 designated a display unit such as LCD for displaying set values and matter required for operation. In the processing unit 17, arithmetic operation is executed on the basis of a relation formula for obtaining the same tension as the set value according to characteristics (for example, non-linearity) of the actuator. The result obtained by the arithmetic operation is supplied to a signal bus line 20 through a transmission unit 19 as an analog signal through D/A converter or as a digital signal. A form of the signal supplied to the bus line 20 may be selected to have the optimum one according to the transmission distance, quantity of winding units and the like.

Figure 3:
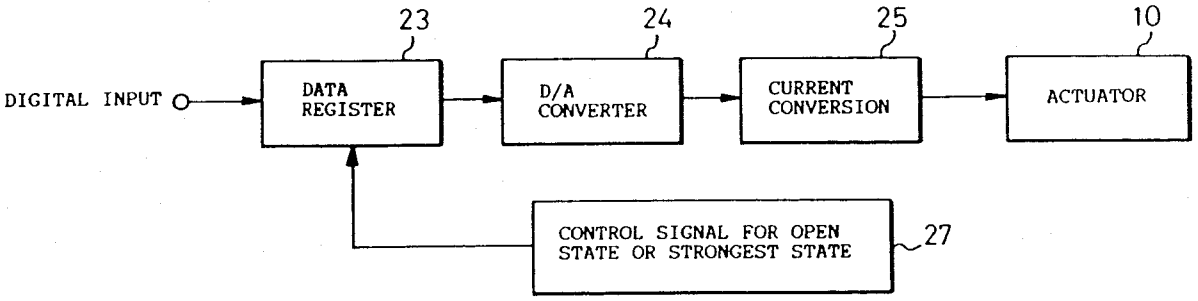
FIG. 3 is a block diagram showing another example of the same.

FIGS. 2 and 3 are respectively block diagrams concerning the tension device in the winding unit (Ui), FIG. 2 being the case of analog input, and FIG. 3 being the case of digital input. That is, in FIG. 2, analog voltage is subjected to current conversion 22 by V/I converter 21 to drive the actuator 10 whose torque is varied according to the magnitude of current. On the other hand, in FIG. 3, a digital signal inputted in serial or parallel is stored in an internal register 23, after which it is subjected to D/A conversion 24 and to current conversion 25 to drive the actuator 10.

The actuator 10 is current-driven because a coil resistance is changed by rise of temperature of the coil due to heat generation of the actuator itself, as a result of which current is changed to prevent a change of torque.

Signals 26 and 27 comprise control signals applied to the winding units, by which the tenser is placed into an open state or the strongest state. For example, the tenser is opened by a yarn joining command signal of the winding unit for placing between tension disks in an open state for insertion of a yarn during joining to facilitate insertion of the yarn. On the other hand, the strongest state is that for example, for preventing a yarn on the side of a feed bobbin from being wound about the drum 5 when tension cut occurs in the vicinity of the drum in FIG. 4, the movable tension disk 8 is firmly pressed against the fixed disk 7 to clamp it to the extent that the travel of yarn is impaired. In this case, if a yarn-present signal caused by the slub catcher is detected despite the fact that a yarn transverse is not detected, the strongest signal is provided in the corresponding unit.

That is, in the above-described embodiment, an automatic winder organized by the provision of plural units of winding unit (Ui) having a tension mechanism 3 composed of a voltage/current converter 21 and an actuator 10 for producing a torque by said current has a DC voltage generator having a constant relationship with tension and a setting unit and a bus mechanism for supplying said voltage to a plurality of winding units. Therefore, setting of winding tension required for each unit every time a yarn used is changed in the past can be eliminated, and collective concentrated setting by remote control can be made.

The above-described tension device is not limited to one shown but a gate tenser for travelling a yarn in a zig-zag form, a roller tenser for winding a yarn about a roller to apply resistance to rotation of the roller by an electromagnet, and the like can be applied.

As described above, in this embodiment, tension setting of each winding unit can be collectively made by remote control, and particularly, the invention is effective in a winder in which lot change of kinds of yarns is often carried out as in a spinning winder, thus enabling to relieve a burden imposed on an operator and fine adjustment can be made.

A tension control method for each winding unit will be illustrated hereinafter.

According to another embodiment of the present invention, a variable tenser is provided on a winding unit, and the variable tenser is controlled as the layers of yarn of a package increases to thereby wind the yarn with the association between the yarn layers and winding tension.

The embodiment will be described with reference with reference to the drawings.

Figure 7:
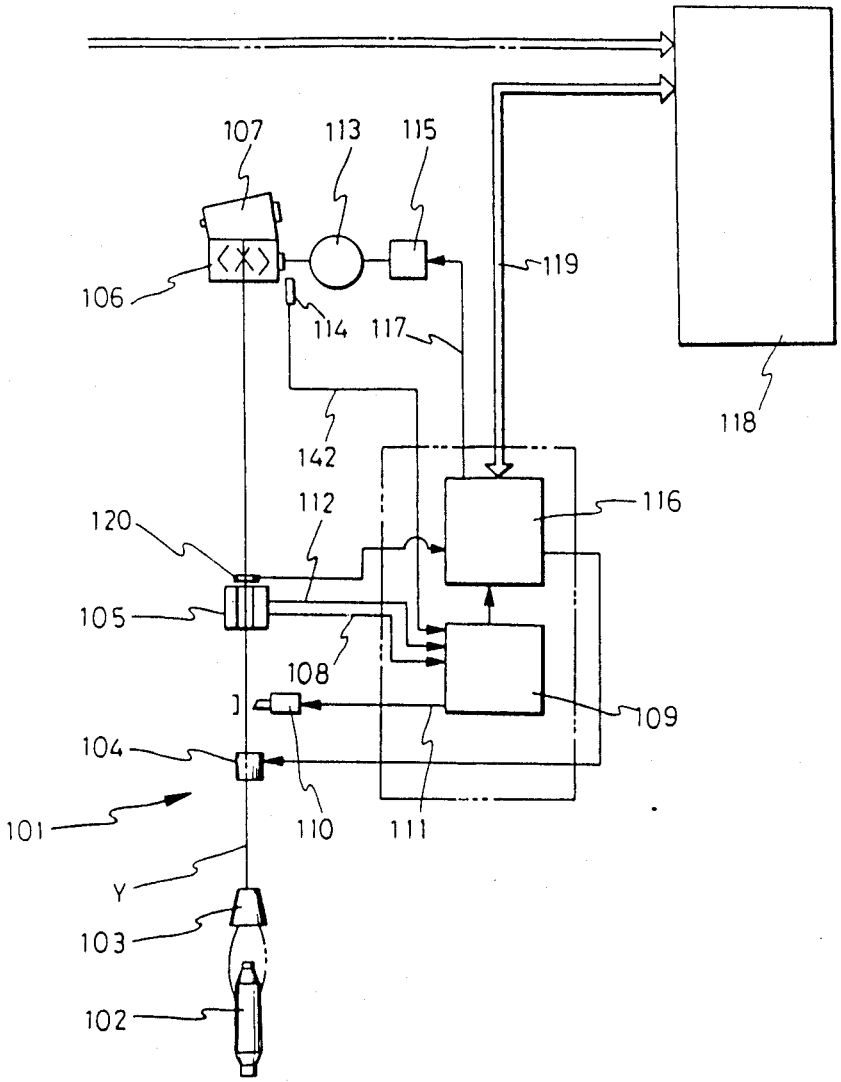
FIG. 7 is a schematic structure showing one example of a winding unit suitable for carrying out the method of the present invention.

A winding unit 101 embodying the embodiment is shown in FIG. 7. A yarn Y released from a feed bobbin 102 is wound about a package 107 rotated by a traverse drum 106 via a balloon breaker 103, a variable tension device 104, a slub catcher 104 and the like.

During the winding, a variation in thickness of a yarn passing through the slub catcher 105 is inputted as an electric signal into a clearer controller 109, and if it exceeds an allowable range from comparative arithmetic operation with a reference value, judgement is made that a yarn defect has passed therethrough. Immediately, a command signal 111 is released to a cutter drive device 110, and the cutter is actuated to forcibly cut a yarn. Upon the cutting of yarn, a yarn travel signal 112 from the slub catcher 5 is turned off and a yarn cut is sensed, whereby a command for stopping a traverse drum drive motor 113 is issued from the controller 109 to stop rotation of the drum 106. Subsequently, a command signal is issued from the controller to start yarn joining operation by a joining device, whereby yarn joining is carried out by known joining means.

In FIG. 7, reference numeral 114 designates a pulse generator for detecting rotation of the traverse drum 105. The pulse generator comprises, for example, a magnet secured to a part of a drum end and a proximity sensor, which pulse generator is applied to a constant length mechanism for calculating a length of wound yarn from the number of revolutions of the drum.

In FIG. 7, the drum driving motor 113 provided on each winding unit is controlled in its rotational speed by an inverter 115 provided on each winding unit. That is, in each winding unit, there is provided a control device 116 for controlling a motor to an optimum rotation speed from the winding state of each unit. A rotational speed of the drum motor 113 is set through the inverter 115 by a control signal 117 put out of the control device 116.

The control of all winding units in the winder is commanded by a central processing unit 118 to the inverter 115 through a signal line 119. That is, the controls common to all the units include, for example, setting of a basic yarn speed according to the kind of yarns wound back or ON/OFF signals of the motor for a ribbon breaker, and the like.

Further, in the present invention, a tension sensor 120 for detecting tension of a yarn is installed in a yarn travel path. For example, a sensor applied with a piezoelectric element can be applied as the tension sensor. That is, the aforesaid element gives rise to a mechanical strain due to pressure applied from outside and a voltage is changed by said strain.

Figure 10:
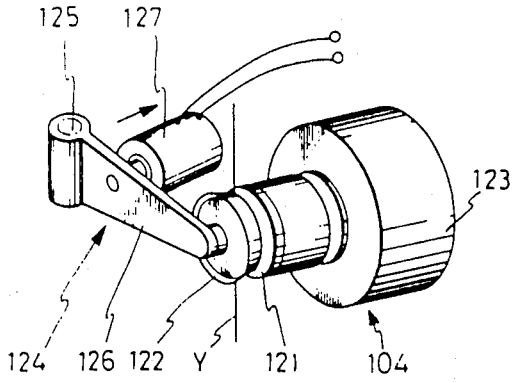
FIG. 10 is a perspective view showing one example of a variable tension device.
Figure 11:
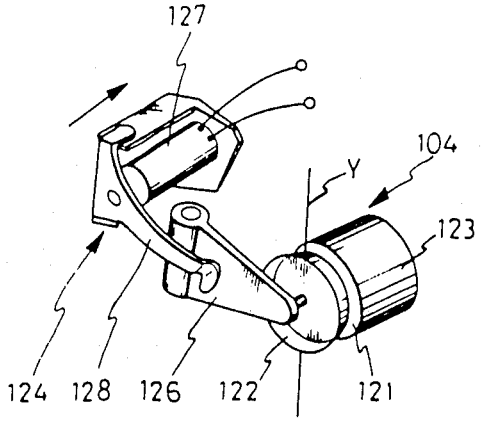
FIG. 11 is a perspective view showing another example of the variable tension device.

One example of the variable tenser is shown in FIGS. 10 and 11. A tenser 104 is provided with a block 123 in the fixed form for supporting a press plate 121 in a fixed state, and a solenoid device 124 for supporting other press plate 122 in a movable state. The solenoid device 124 has an arm 126 pivotable about a shaft 125 approximately parallel with the yarn Y and a solenoid 127 for controlling the pivotal amount of the arm 126. That is, the solenoid body 127 adjusts an amount for pressing the press plate 122 against the press plate 121 opposed thereto through the arm 126 in accordance with the command from the control device. In the other example shown in FIG. 1, the press plate 122 is pressed by a spring plate 128.

Alternatively, a variable tension device can be also employed in which a press plate is mounted on an output shaft of a rotary solenoid to electrically control a rotational angle of an output shaft of the solenoid.

Next, the tension control method by the above-described apparatus will be described hereinafter.

Figure 8:
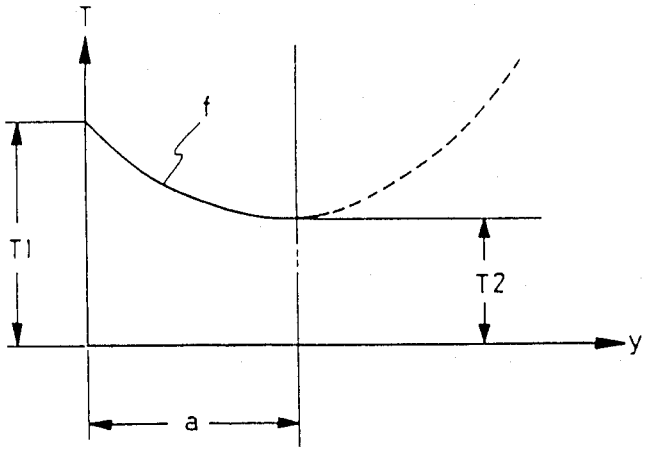
FIG. 8 is a diagram showing the relationship between a yarn layer and tension.

FIG. 8 shows an embodiment wherein winding tension T is changed as the yarn layers y increase. That is, in this case, at the beginning of winding, initial tension T1 greater than a steady-state tension T2 in a normal steady-state region is applied, and there is provided a tension release range (a) for controlling tension T according to the yarn layers y till a certain set amount of yarn layers (a mm) is reached.

To detect the yarn layers of a package, a displacement of an arm may be detected by a detector but the detector device is so complicated as not to be practical. Thus, the present invention makes use of the constant length count number interrelated with the yarn layer of the package. That is, the measurement of yarn wound on the package is determined by the constant length count number thereby to effect tension control.

Figure 9:
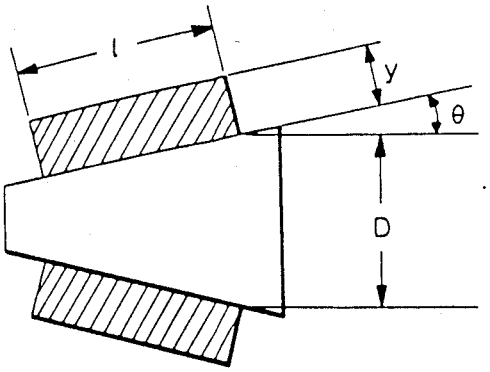
FIG. 9 is an explanatory view for symbols showing the sizes of parts of the package.

The relationship between the constant length count number and the amount of yarn on the package will be described hereinafter. In FIG. 9, let y (mm) be the height of yarn layers with respect to the outer surface of a winding tube, $\theta$ the angle of cone, D (mm) the diameter on the large diameter side of a winding tube, l (mm) the traverse width, and V ($mm^3$) the volume of yarn, then, $$V = \pi l[y^2 \cos\theta + y(D - L\sin\theta)] \quad \text{(a)}$$

Let N be the constant length count number, L (m) the yarn length of constant length 1 count, Nm (m/gr) the count of yarn, and S ($gr/cm^3$) the winding density, then, $$NL = VSN\ m/1000 \quad \text{(b)}$$

From Equations (a) and (b), $$N = \pi SNml/1000\ L[y^2 \cos\theta = y(D - l\sin\theta)] \quad \text{(c)}$$

On the other hand, in FIG. 8, control is made so that till reaching the yarn layer height (a) on the package winding tube, the winding tension T reduces along a parabola f from initial tension T1, and a steady-state tension T2 is obtained from the yarn height (a), then in the relation of $0 \leqq y \leqq a$ $$T = (T1 - T2)\left(\frac{y - a}{a}\right)^2 \quad \text{(d)}$$

In the relation of $a \leqq y$, $$T = T2 \quad \text{(e)}$$

Suppose that the relationship between the constant length count number (N) and the winding tension (T) be called the release function, if y is eliminated from the above-described Equations (c), (d) and (e), the relative equation of N and T can be obtained. However, this is an extremely complicated equation. Therefore, actually, in the case where a calculator is used for calculation, y is changed little by little in the section of $o \leqq y \leqq a$, and the relationship between N and T at that time is stored in a memory, then the release function may be obtained.

The system for controlling tension in accordance with the release function obtained by the calculation as described above will be described with reference to FIG. 6. Reference numeral 130 designates a small computer provided within a control box installed at the end of a machine bed of an automatic winder or a central control chamber. The computer has a measuring function, a monitoring function and a concentrated control function of each winding unit, the illustrated functions being a tension set control device. The control device 130 comprises a constant length counter 131 for counting constant length pulses fed from a winding unit, a calculator 132 for obtaining a release function from winding conditions inputted in advance, an N/T converter 133 for obtaining a set tension from the count number outputted from the counter 131, and the like.

On the other hand, reference numeral 140 designates a microcomputer installed on each winding unit 101, which microcomputer is provided with a tenser control device for applying actual tension on the basis of a designated tension outputted from the N/T converter 133.

Figure 6:
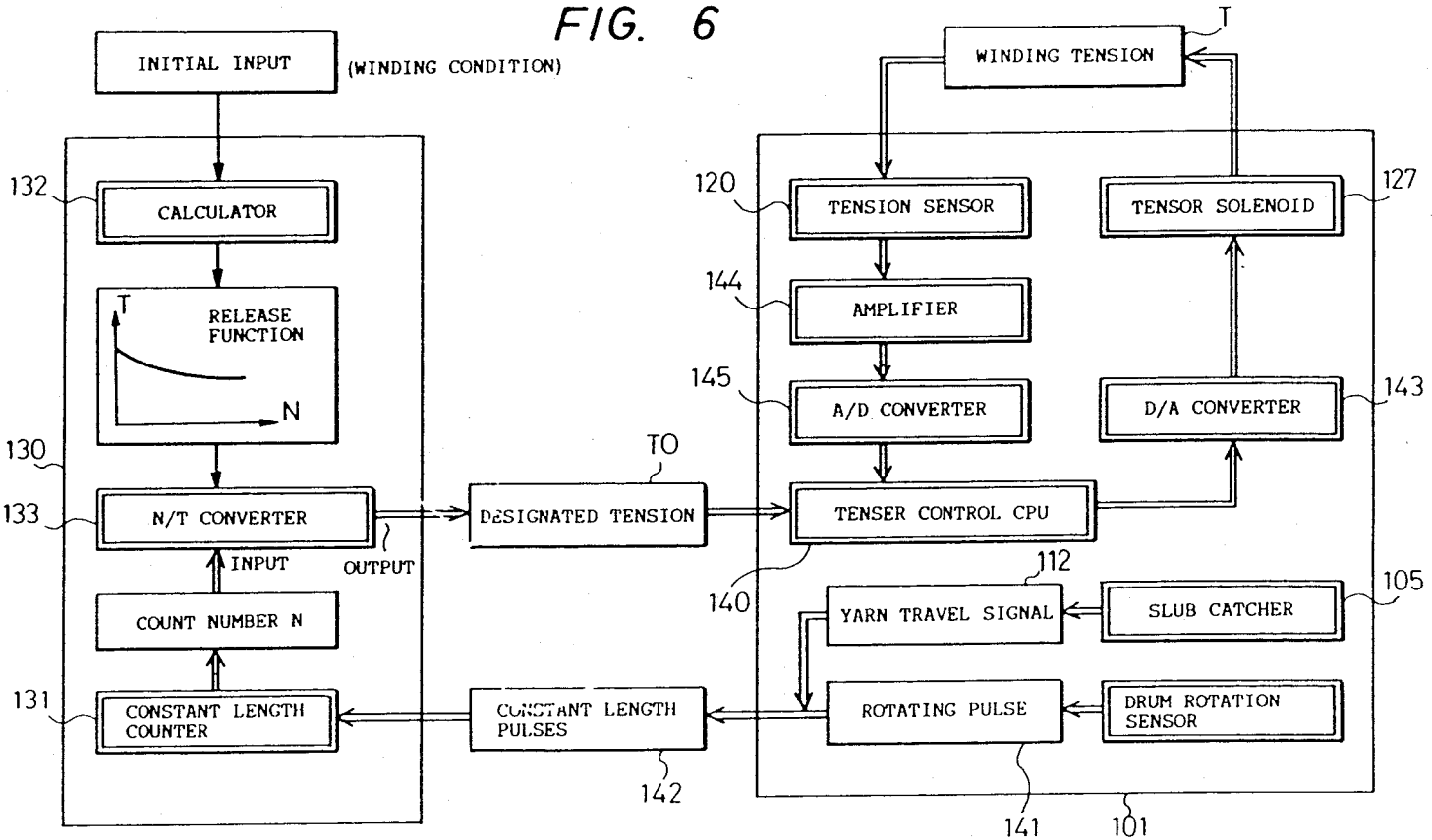
FIG. 6 is a block diagram showing another embodiment of the method according to the present invention.

In FIGS. 6 and 7, outputted from the unit 101 are a yarn travel signal 112 obtained from a slub catcher 105 on the unit side and a constant length pulse 142 obtained by AND of a rotating pulse 141 obtained from a drum rotation sensor 114. That is, the constant length pulse 142 is a pulse signal issued only when the yarn actually travels, said signal being inputted into a constant length counter 131 within the body control box. The count number N counted by the counter 131 is inputted into the N/T converter 133, and tension T corresponding to the count number N is outputted as a designated tension T0 at the yarn layer height y to the winding unit 101 on the basis of the release function of N and T as described above.

On the other hand, in the winding unit 101, a current suitable for applying the designated tension is supplied to a tenser solenoid 127 through a control 140 and D/A converter 143 on the basis of the aforesaid designated tension signal T0 whereby the urging force of the solenoid 127 shown in FIG. 10 is controlled and a yarn nipping force between the press plates 121 and 122 is set. In this manner, winding tension T applied to the yarn is detected by the tension sensor 120. Signals obtained by the tension sensor 120 are inputted into the control 140 via an amplifier 144 and an D/A converter 145 and controlled so as to follow the release function. That is, as shown in FIG. 8, the winding tension T reduces in the form of a parabola f from the initial tension T1, and when the yarn y comes to (a), unwinding is carried out in the state of constant tension T2.

Initial items inputted into the microcomputer are, as previously mentioned, the angle $\theta$ of cone, diameter D(mm) on the large diameter side of the winding tube, traverse width (lmm), yarn length (Lm) of constant length 1 count, count (Nm or Ne) of yarn, winding density S (gr/cm$^2$), release range (a mm), initial tension value T1, and steady-state tension value T2. The above-described values are changed according to the kind of yarns.

As described above, according to the above embodiment the tension corresponding to the number of yarn layer of the package can be applied on the basis of the constant length pulse signal, and a package with a well arranged winding shape can be obtained. Moreover, a complicated device for always detecting a yarn amount of a package need not be provided, and tension of each unit can be controlled from a control room remoted from the winder bed. Still another embodiment of tension control method will be now described.

Figure 12:
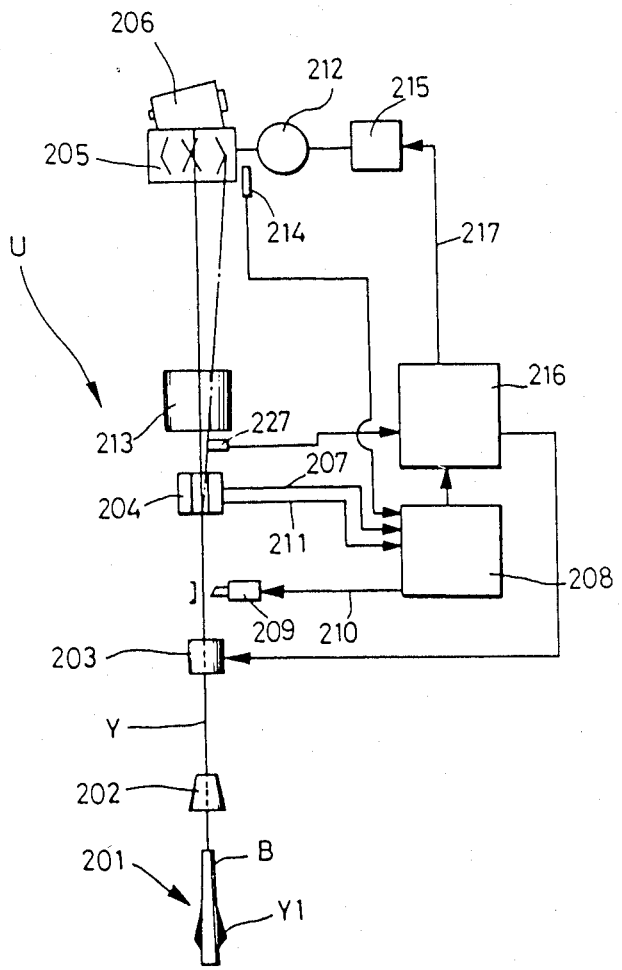
FIG. 12 is a schematic structural view showing one example of a winding unit for embodying still another embodiment of the method of the present invention.

FIG. 12 shows one example of a winding unit U constituting an automatic winder. A yarn Y released and drawn out of a spinning bobbin 201 passes through a balloon breaker 202 and a tension device 203, and wound on a package 206 rotated by a traverse drum 205 while a defective yarn is being checked by a yarn defect detection head 204 such as a slub catcher.

During the winding, a variation of thickness of a yarn passing through the slub catch 204 is inputted as an electric signal 207 into a clearer controller 208, and if it exceeds an allowable range from comparative arithmetic operation with a reference value, judgement is made that a yarn defect portion has passed therethrough. Immediately, a command signal 210 is released to a cutter drive device 209 from the controller 208, and the cutter is actuated to forcibly cut a yarn. Upon the cutting of yarn, a yarn travel signal 211 from the slub catcher 204 is turned off and a yarn cut is sensed, whereby a command for stopping a traverse drum drive motor 212 is issued from the controller 208 to stop rotation of the drum 205. Subsequently, a command signal is issued from the controller to start yarn joining operation by a joining device 213, whereby yarn joining is carried out by known joining means.

In FIG. 12, reference numeral 214 designates a pulse generator for detecting rotation of the traverse drum 205. The pulse generator comprises, for example, a magnet secured to a part of a drum end and a proximity sensor, which pluse generator is applied to a constant length mechanism for calculating a length of wound yarn from the number of revolutions of the drum.

In FIG. 12, the drum driving motor 212 provided on each winding unit is controlled in its rotational speed by an inverter 215 provided on each winding unit. That is, in each winding unit, there is provided a control device 216 which will be described later for controlling a motor to an optimum rotational speed from the winding state of each unit. A rotational speed of the drum motor 212 is set through the inverter 215 by a control signal 217 put out of the control device 216.

Figure 14:
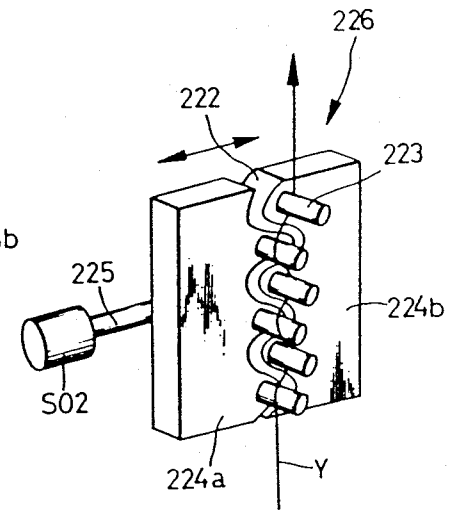
FIG. 14 is a perspective view showing still another example of the tension device.
Figure 13:
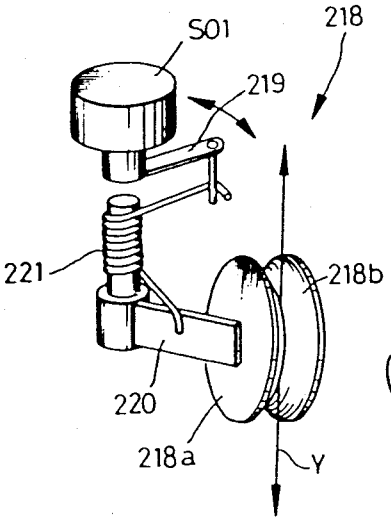
FIG. 13 is a perspective view showing another example of a tension device.

One example of the tension device 203 is shown in FIGS. 13 and 14. In a tension device 218, in which a yarn Y is held between two disks **218*a* and 218*b*, one of which is fixed and the other being pressed thereagainst, the movable disk 218*a* is oscillatably supported by a support arm 220, a spring 221 is provided opposite ends of which are engaged with an oscillating rod 219 oscillated by normal and reverse rotation of a rotary solenoid SO1 and the support arm 220 of said disk 218*a*, the rod 219 being oscillated by normal and reverse rotation of the rotary solenoid SO1 to increase and decrease the urging force of the speing 221 thereby changing the pressing force between two disks 218*a* and 218*b*** to sequentially control the tension of the travelling yarn Y.

In an example of a tension device 226 shown in FIG. 14, the device comprises two gate plates **224*a* and 224*b* having on their sides undulated convavo-convex surfaces 222 engated with each other and provided with a plurality of short rods 223 projected at right angles to the direction of the undulations at the top of each undulation, and a drive mechanism 225 for moving forward and backward one gate plate 224*a* by rotation of a rotary solenoid SO2 to increase and decrease the amount of engagement between the undulated concavo-convex surfaces. An angle in contact with the short rods is varied with respect to a yarn Y which is travelled in a zig-zag manner on the surfaces of the short rods 223 by forward and backward movement of the gate plate 224***a* to sequentially control the tension of the travelling yarn Y.

The tension sensor 227 shown in FIG. 12 comprises a sensor to which a piezoelectric element is applied, which is provided in a portion to be pressed by a yarn at the traverse end.

Figure 15:
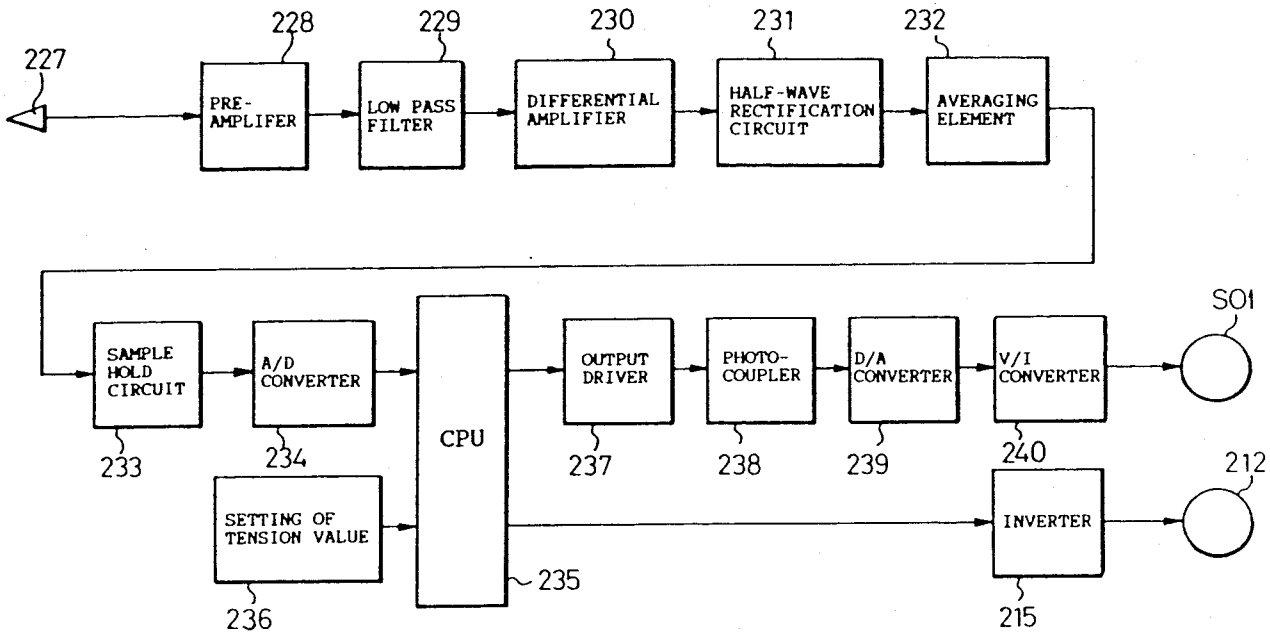
FIG. 15 is a block diagram showing one example of a control device 216.

FIG. 15 is a block diagram of the control device 216 shown in FIG. 12, in which a signal obtained at a sensor head 227 is amplified to sufficiently large magnitude by a pre-amplifier 228, and an unnecessary component is removed by a low pass filter 229. Output of the low-pass filter 229 is supplied to a half-wave rectification circuit 231 with the same phase noise removed by a differential amplifier 230. In the half-wave rectification circuit 231, only the component applied as a tension of yarn to the sensor head is removed. The output of the half-wave rectification circuit is inputted into an averaging element 232 for average. The averaged signal is supplied to a sample hold circuit 233 and an A/D converter 234.

CPU 235 periodically controls the sample hold circuit 233 and the A/D converter 234 to read a tension value. A difference from a reference tension value 236 having been inputted and set is compared and calculated from the result obtained by said reading, outputting at 237 data to the tenser control device.

That is, (1) when the reference tension value is smaller than the present tension, tenser control output value is made small to decrease a yarn nipping force of the tenser to move the tension downward. (2) When the reference tension value is larger than the present tension, the tenser control output value is made large to increase a yarn nipping force of the tenser to move the tension upward. (3) When the reference tension value is equal to the present tension, the tenser control output value remains unchanged. After the output released from CPU 235 has been isolated by a photo-coupler 238, it is converted into an analog signal (voltage) by D/A converter 239. This voltage is subjected to current conversion by a V/I converter 240 to drive a rotary solenoid (SOL in FIG. 13) for adjusting a tenser to control a nipping force of a yarn. Such a control is repeated to continue controlling so as to enter a region of a reference tension.

On the other hand, in the case where the tension is increased even by the aforementioned control of tension, that is, in the case where the tension exceeds the range of controllable tension such that the tension increases despite the fact that the nipping force of the tenser is zero, the yarn travel speed is controlled. That is, the driving motor 212 for the traverse drum 205 is controlled by the control device 216 shown in FIG. 12 through the inverter 215, to decrease the rotational speed.

Figures 16, 17, 18:
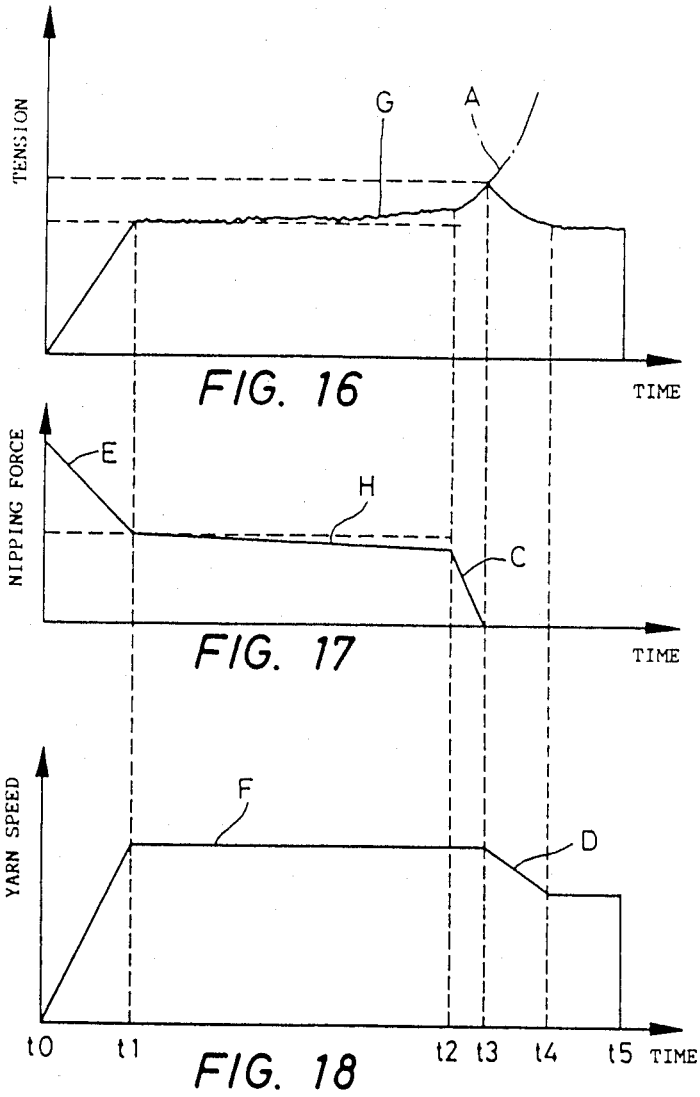
FIG. 16 is a diagram showing one pattern of variation in tension of a yarn when yarn is released from a bobbin.
FIG. 17 is a diagram of a nipping force showing a tension control method according to an embodiment of the present invention.
FIG. 18 is a diagram of yarn speed showing said method.

The relationship between the variation of tension, the nipping force of the tenser and the yarn speed is shown in FIGS. 16 to 18. In FIG. 16, a variation of tension when a yarn is released from one bobbin and then wound is generally as shown. When a constant winding speed is reached from beginning t0 of winding, the tension is approximately constant, and as the yarn layers on the bobbin reduce, the tension gradually increases. In the vicinity of the final point, the tension tends to apruptly increase A as mentioned above. Accordingly, if the yarn speed is decreased from an abrupt increase point t2 of tension, the tension decreases as the yarn speed decreases. However, it is not preferable to decrease the winding speed in view of working efficiency of the entire winder. Accordingly, in the present invention, the yarn speed is not decreased within the time from the abrupt increase point t2 of tension but tension is controlled by the decrease C of the nipping force of the tenser. That is, during time t2 to t3, tension is controlled by the tension device 203, and during time t3 to t5, the tension device is already open. Therefor, the tension control is impossible by the tension device, during which the yarn speed is firstly brought down, as shown at D to thereby control the tension.

In FIGS. 16 and 17, the nipping force is varied E during time t0 to t1 in an attempt of preventing a disordery traverse since in the rise at the beginning of winding, tension is small and therefor the yarns tend to be gathered in the vicinity of the central portion of a package by means of a centrifugal force. During time t0 to t1, a nipping force greater than that during normal winding is provided to thereby compensate for a relatively low degree of tension occurring during the rise of the yarn speed between t0 and t1.

During the winding at constant speed during time t1 to t2, the yarn speed is constant F as shown in FIG. 18, the tension tends to increase G as winding proceeds as shown in FIG. 16, i.e., as the yarn layers of the bobbin on the feed side reduce. Thus, during that period, the nipping force of the tension device gradually decreases H.

As described above, according to the above embodiment, even in the region where tension rapidly increases, the yarn speed is not decreased but the yarn tension is controlled by the tension device, and when the tension is outside the range of controllable tension of the tension device, the yarn speed is decreased to thereby control the tension. As a whole, the yarn speed is maintained by normal winding speed whereby the lowering of the working efficiency of the winder can be avoided, providing the remarkable effect particularly in the high speed winder of 1000 to 2000 m/min.

A method for inspecting a yarn joining device by using the tension device which has been described hereinbefore will be illustrated.

In the past, for inspecting each joining device mounted on each of winding units constituting an automatic winder, a large-scaled inspecting device has been used which is loaded on a movable truck which runs on the rail along the automatic winder (For example, see Japanese Patent Application Laid-Open Publication No. 201031/1986). According to this device, a joining command is issued to a winding unit to effect yarn joining by the joining device, and thereafter a portion of a joint is cut off and introduced into an inspecting device, which part is set to a measuring mechanism to apply tension thereto for measurement of characteristics of a specimen yarn. This operation is combersome.

In the conventional method for inspecting a yarn joint using an inspecting device provided separately from a winding unit, as described above, there involves disadvantages in that the device becomes large-scaled and expensive, and that cumbersome steps such as collection, transporting, setting, measurement and the like of yarns are required.

A method for inspecting a joining device which can judge quality of the joining device by an extremely simple device and procedure will be now described.

In the method for inspecting a yarn joining device according to the present invention, tension which is greater than that normally applied by the tenser device but smaller than that applied in a test of yarn strength is applied to a joined yarn immediately after joining by the joining device. When a yarn breakage occurs, joining is again carried out to repeat application of tension by the tenser device. When yarn breakages occur for frequency set, judgement is made that the joining device is abnormal.

When tension greater than that normally applied by the tenser device is applied to a joined yarn immeidately after the joining, that tension is also applied to a yarn joint since the yarn joint is not yet wound on the package.

If the yarn breakage occurs, it can be regarded that the yarn breakage occurred at a yarn joint weaker than other parts. If a yarn breakage occurs at a yarn joint, the joining device involves the cause of a yarn breakage. Thus, if a set frequency of yarn breakages occur in repetition, the possibility that the joining device is defective is extremely high. As the result, abnormality of the joining device can be judged.

Figure 20:
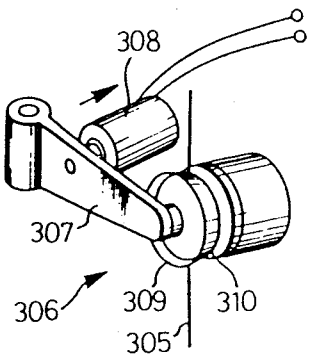
FIG. 20 is a perspective view of a tenser device shown in FIG. 19.

One embodiment of the method will be described with reference to FIGS. 19 and 20.

Figure 19:
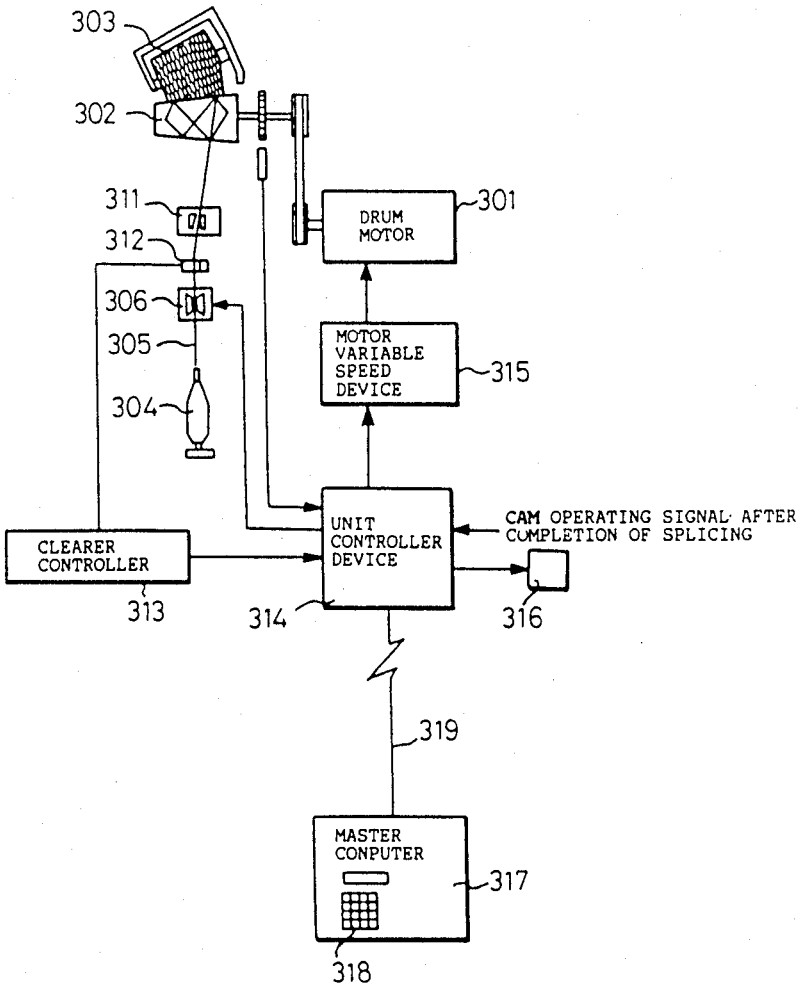
FIG. 19 is a structural view showing an embodiment of an inspection system for a joining device for explaining the method according to the present invention.

FIG. 19 shows an example of an inspection system for a joining device for explaining the method.

In a winding unit of an automatic winder, a yarn 305 fed from a feed bobbin 304 is wound on a package 303 rotated by a drum 302 driven by a drum motor 301. A tenser device 306 is provided to provide smooth winding, and applies moderate tension to the yarn to be wound. The tenser device 306 is designated so that as shown in FIG. 20, a lever 307 one end of which is rotatably supported is attracted by an electromagnet 308, a movable disk 309 mounted on the other end of the lever 307 is urged against a fixed disk 310, and the yarn 305 travelling between the disks 309 and 310 is applied with tension corresponding to an amount of energization energized to the electromagnet 308 so that the yarn may be wound on the package from the feed bobbin.

The winding unit is provided with a joining device 311 for joining together a yarn extending from the feed bobbin 304 and a yarn extending from the package 303. The joining device 311 operates as follows, when a yarn breakage occurs.

When a yarn breakage occurs, it is detected by a yarn clearer comprising a yarn clearer head 312 and a clearer controller 313, which is inputted into a unit controller device 314 loaded with a microprocessor. When a yarn-breakage signal is inputted into the unit controller device 314, the microprocessor issues a stop command to an inverter as a motor variable speed device 315 to stop the drum motor 301. Thereafter, a series of operation for joining is started by energization of a joining start clutch 316 to complete joining by the joining device 311.

The aforesaid joining device can be an air type splicing device producing no knot called a pneumatic yarn splicing device, or mechanical yarn joining device or weavers knotter.

The above-described device is already installed on the winding unit. However, in the present embodiment, the joining device 311 and the tenser device 306 are utilized without modification and a program of the unit controller device 314 is slightly modified whereby the inspection of the joining device 311 is carried out as will be described hereinafter.

When joining has been completed by the joining device 311 and a cam signal of joining completion is inputted into the unit controller device 314, the unit controller device 314 outputs a tenser control signal to the tenser device 306 so as to be apply tension of approximately 60% of strength of the yarn immediately after completion of joining by the joining device 311, to control the tenser device 306.

Thereafter, the unit controller device 314 issues an operating command to the motor variable speed device 315 to slow-start the drum motor 301. Thereby, powerful tension of approximately 60% is applied to the yarn 305 between the tenser device 306 from the package 303 on the drum 302 including the joining device 311 portion. If the joining device 311 is defective, a yarn breakage occurs from a joint, and therefore, if a yarn breakage occurs, the possibility that the joining device 311 is defective is high. However, it will be a question to decide that the joining device is defective when a yarn breakage once occurs. Therefore, when a yarn breakage occurs, the aforesaid procedure is repeated for frequency set, and when yarn breakages occur for frequency set, judgement is made that the joining device 311 is defective.

Since the clear cut by the yarn clearer is expected to be made by the passage of a yarn defect during the judgement, there is a fear that said cut may not be discriminated from the cut caused by the inspection. However, when the clear cut is made, a cutter operating signal not having been outputted during inspection is outputted to the unit controller device 314 by the clearer controller 313, and therefore, the aforesaid discrimination can be made.

The amount of tension applied by the tenser device 306 for inspection of the joining device 311 can be suitably set, said value being set to a setting portion of a master computer 317 controlling the unit controller devices 314, whereby it is given through a communication line 319. Thereby, any kind of yarn can be processed.

As described above, according to the above-described embodiment, function of the joining device can be confirmed according to the fact whether or not a yarn breakage occurs within a fixed period of time or within the range of a fixed winding amount immediately after joining or after drum has been started. Moreover, this confirmation of function not only utilizes the existing equipment without modification but transport of yarn need not be required. Therefore, the operation can be realized by the extremely simple device and method, thus requiring no large-scaled and expensive device and requiring no cumbersome steps for collection, transporting, setting and measurement of yarns.

According to the embodiment, the quality of the joining device can be judged by the extremely simple device and procedure in which the joining device and tenser device established on the winding device are utilized without modification.

What is claimed is:

1. A tension control method in an automatic winder having a winding unit for performing a winding operation, the method comprising the steps of:

generating a constant length pulse signal with a constant length pulse generator associated with the automatic winder, determining the amount of yarn wound on a yarn package on the basis of the constant length pulse signal generated by the constant length pulse generator, and applying a designated tension corresponding to the determined amount of yarn to a travelling yarn through a variable tenser associated with the winding unit.

2. The tension control method as claimed in claim 1, wherein the step of applying a designated tension comprises the steps of:

applying an initial tension greater than a steady-state tension at the beginning of a winding operation;

releasing the tension over a tension release range; and controlling the releasing of tension according to the amount of yarn wound during the winding operation.

3. The tension control method as claimed in claim 1, wherein the step of determining comprises the steps of:

inputting winding conditions data in a control device;

counting constant length pulses;

obtaining a release function from the inputted winding conditions data;

obtaining a tension signal from the count of constant length pulses and the release function; and applying actual tension to the yarn on the basis of the tension signal.

4. In an automatic winder provided with a plurality of winding units, a tension sensor for detecting tension of a travelling yarn and for providing a tension variation signal for each winding unit, a tension device operable within a tension range for controlling tension of a yarn on the basis of the tension variation signal provided by said sensor, and winding speed control means for controlling winding speed of the yarn on the basis of the signal provided by said tension sensor, a method of controlling yarn tension comprising the steps of:

controlling yarn tension with the tension device; and controlling the winding speed by the winding speed control means upon the yarn tension exceeding the operable tension range of the tension device.

5. The tension control method as claimed in claim 4, wherein the step of controlling the winding speed comprises the step of controlling a driving motor for a traverse drum by a control device through an inverter to decrease a rotational speed thereof.

6. In an automatic winder provided with a plurality of winding units, each winding unit having a tension device and a yarn joining device for joining together a yarn extending from a feed bobbin and a yarn extending from a package, a method of controlling yarn tension comprising the steps of:

joining yarns with the yarn joining device;

applying tension, which is greater than that normally applied by the tension device but smaller than that applied in a test of yarn strength, to the joined yarn after the step of joining by the joining device;

detecting whether a yarn breakage occurs following the step of applying tension;

repeating the steps of joining, applying and detecting upon the detection of a yarn breakage;

detecting the frequency of detected yarn breakages; and comparing the detected frequency with a preset value, wherein upon the detected frequency exceeding the preset value, a judgment is made that the joining device is abnormal.

7. A method for inspecting a yarn joining device operable for joining together a yarn on the side of a feed bobbin and a yarn on the side of a package, and operable with a tension device for controlling tension of a yarn wound on the package from the feed bobbin, the method comprising the steps of:

joining yarns with the yarn joining device;

applying tension, which is greater than that normally applied by the tension device but smaller than that applied in a test of yarn strength, to the joined yarn after the step of joining by the joining device;

detecting a yarn breakage occurring following the step of applying tension;

repeating the steps of joining, applying and detecting upon the detection of a yarn breakage;

detecting the frequency of detected yarn breakages; and comparing the detected frequency with a preset value, wherein upon the detected frequency exceeding the preset value, a judgment is made that the joining device is abnormal.

8. In a yarn winding apparatus operatively controlled by a control device and having a yarn tension detector to detect yarn winding tension, as wound yarn detector for detecting the amount of yarn wound and a yarn tension adjuster to adjust yarn winding tension, a method of controlling yarn tension comprising the steps of:

determining a functional relationship between yarn tension and amount of yarn wound;

detecting the amount of yarn wound;

determining the yarn tension value which is functionally related, according to the determined functional relationship, to the detected amount of yarn wound; and adjusting the yarn winding tension with the yarn tension adjuster toward the determined tension value.

9. A method as claimed in claim 8, wherein the yarn tension adjuster operates to adjust yarn winding tension when the value of the yarn winding tension is within a predefined range, the method further comprising the step of adjusting the winding speed of the yarn winding apparatus upon the value of the yarn winding tension exceeding the predefined tension range.

10. A method as claimed in claim 8, wherein said step of determining a functional relationship comprises the steps of:

determining a steady-state tension value;

determining a starting tension value which is higher than the steady-state tension value; and determining a function reducing the yarn winding tension from the starting tension value to the steady-state tension value as winding proceeds following the starting of a winding operation.

11. A method as claimed in claim 10, wherein the step of adjusting the yarn winding tension comprises the step of:

reducing the yarn winding tension from the starting tension value to the steady-state tension value between the starting of a winding operation and the point in the winding operation when the detected amount of yarn reaches a predetermined amount.

12. A method as claimed in claim 8, wherein the step of determining a functional relationship comprises the steps of:

determining a steady-state tension value;

determining a starting tension value which is greater than the steady-state tension value; and determining a tension release function by which the starting tension is reduced over a winding period to the steady state yarn winding tension.

13. A method as claimed in claim 12, wherein the winding period is determined by the amount of yarn wound.

14. In a yarn winding apparatus having an adjustable yarn tenser operable in a predefined yarn tension range, and also having a yarn winding speed controller, a method of controlling yarn winding tension comprising the steps of:

sensing the yarn winding tension;

adjusting the yarn winding tension with the adjustable yarn tenser upon the yarn winding tension being within the predefined tension range; and adjusting the winding speed with the winding speed controller upon the yarn winding tension exceeding the predefined range.

15. A method as claimed in claim 14, further comprising the steps of:

providing a tension signal having a value dependent on the sensed yarn winding tension;

comparing the value of the tension signal with a preset value; and determining whether the yarn winding tension exceeds the predetermined range in dependence upon the result of the step of comparing.

16. In a yarn winding apparatus operatively controlled by a control device and having a yarn tension detector to detect yarn winding tension and a yarn tension adjuster to adjust yarn winding tension, a method of controlling yarn tension comprising the steps of:

inputting data to the control device, the input data corresponding to at least one of the kind of yarn processed with the yarn winding apparatus, the thickness of the yarn processed with the yarn winding apparatus, and the standard winding speed of the yarn winding apparatus;

determining a tension value based on the data input to the control device; and adjusting the yarn winding tension with the yarn tension adjuster toward the tension value determined by the control device.

17. A method as claimed in claim 16, further comprising the steps of:

detecting the value of the yarn winding tension with the yarn tension detector; and comparing the detected yarn tension value and the tension value determined by the control device;

wherein the step of adjusting comprises the step of adjusting the yarn winding tension with the yarn tension adjuster toward the tension value determined by the yarn control device upon noncoincidence of the compared tension values.

18. A yarn winding apparatus having an adjustable yarn tenser for adjusting the yarn winding tension for winding yarn about a yarn package, the apparatus comprising:

input means operable for receiving data corresponding to at least one dimension of the yarn package;

calculating means operatively connected with the input means, for determining a functional relationship between yarn tension and amount of yarn wound, the functional relationship being dependent on data received by the input means;

detecting means for detecting the amount of yarn wound about the yarn package; and control means, operatively connected with the calculating means, the detecting means and the adjustable yarn tenser, for controlling the adjustable yarn tensor to adjust the yarn winding tension toward the tension, which is functionally related, according to the functional relationship determined by the calculating means, to a detected amount of yarn wound.

19. A yarn winding apparatus as claimed in claim 18, wherein the input means is further operable for receiving data corresponding to first and second predetermined tension values T1 and T2, respectively, and data corresponding to a predetermined amount of yarn wound a and, wherein the functional relationship between the yarn winding tension T and the amount of yarn wound y is substantially:

$$T = (T1 - T2)\left(\frac{y - a^2}{a}\right)$$

when $0 \leqq y \leqq a$ and $$T = T_2$$

when $a \leqq y$.

20. A yarn winding apparatus for winding yarn at an adjustable winding speed and winding tension, the apparatus comprising:

a yarn tension sensor;

an adjustable yarn tenser operable in a predefined winding tension range;

a winding speed adjuster;

control means, operatively connected with the yarn tension sensor, the winding speed adjuster and the adjustable yarn tenser, for operating the adjustable yarn tenser to control the winding tension when the winding tension is within the predefined tension range and for operating the winding speed adjuster to control the winding tension when the winding tension exceeds the predefined tension range.

* * * * *